US005803784A

United States Patent [19]

Plow et al.

[11] Patent Number: 5,803,784

[45] Date of Patent: Sep. 8, 1998

[54] WIND OPERATED SLIDING SAIL TOY

[76] Inventors: Gregory M. Plow, 10265 Lucky Ct., Gilroy, Calif. 95020; James Palmer, 222 N. Farragut St., Bay City, Mich. 48708

[ * ] Notice: The term of this patent shall not extend beyond the expiration date of Pat. No. 5,259,804.

[21] Appl. No.: 625,338

[22] Filed: Apr. 1, 1996

Related U.S. Application Data

[63] Continuation-in-part of Ser. No. 338,603, filed as PCT/US92/11326, Dec. 30, 1992, abandoned, which is a continuation-in-part of Ser. No. 921,934, Jul. 29, 1992, Pat. No. 5,259,804.

[51] Int. Cl.[6] ..... A63H 33/40

[52] U.S. Cl. ..... 446/176; 446/489; 446/490

[58] Field of Search ..... 446/176, 228, 446/489, 490; 273/351; 473/516, 575; 244/155 R

[56] References Cited

U.S. PATENT DOCUMENTS

| | | | |
|---|---|---|---|
| 1,762,051 | 6/1930 | Cooney | 446/228 X |
| 2,634,127 | 4/1953 | Shapiro | 446/228 X |
| 3,006,586 | 10/1961 | Strelakos, Jr. | 244/155 R |
| 3,893,256 | 7/1975 | Wolf et al. | 473/575 |
| 5,259,804 | 11/1993 | Plow et al. | 446/176 |

*Primary Examiner*—Robert A. Hafer
*Assistant Examiner*—Jeffrey D. Carlson

[57] ABSTRACT

A flying toy having a first and a second guideline support, each guideline having two ends and a handle member respectively secured at each end. A body member for operating aerodynamically may include a frame and sail, or alternatively, the frame and sail may be replaced by a one-piece or composite sail frameless structure. In an alternative embodiment, a single guideline replaces the two guidelines. Support elements are slideably secured to the body member and to the fasteners for supporting the body in a desired orientation between the first and second guidelines. Alternatively, the support elements may be included as a part of the frame of the body member or some embodiments eliminated.

26 Claims, 7 Drawing Sheets

WIND OPERATED SLIDING SAIL TOY

This application is a C-I-P of U.S. application Ser. No. 08/338,603, filed Nov. 16, 1994, abandoned, which is based on application PCT/US92/11326, filed Dec. 30, 1992, now published WO 94/03248, which is a Continuation-In-Part of U.S. application Ser. No. 07/921,934, filed Jul. 29, 1992 now U.S. Pat. No. 5,259,804.

BACKGROUND OF THE INVENTION

1. Field of Invention

This invention relates to flying toys, and more particularly wind driven flying toys having one or more guidelines and capable of reversing direction of flight along the one or more guidelines through manipulation of a handle by a user.

2. Discussion of Prior Art

In the prior art, numerous toys and flying apparatus have been proposed and developed for fun and entertainment, educational purposes, and competition. Flying toys attached to strings, such as kites, have been used and enjoyed for centuries. More recently, a number of aerodynamic toys to be thrown in the air for use in throwing games have become very popular. For example, U.S. Pat. No. 3,359,678 shows a flying saucer; U.S. Pat. No. 3,976,295 shows a tethered disc enabling retrieval if the disc does not make it back to the operator in the course of its flight; U.S. Pat. No. 4,516,946 shows a flying disc construction having an annular roller bearing at its center; and U.S. Pat. No. 4,802,875 showing a tethered flying disc with a two-piece bearing for control of the disc on a support line.

A number of kite string toys and flying devices have been described in the previous literature. Representative examples of issued patents are U.S. Pat. No. 1,172,198, U.S. Pat. No. 2,041,233 and U.S. Pat. No. 3,752,424. All of these devices required manual reset before the device could climb the kite string again before the dive down action. U.S. Pat. No. 4,805,853 provided a modification of this type of device by having means to adjust elevator tabs at the rear wing tips of the device and included a parachute launching mechanism.

Another genre of prior art flying toy using guidelines is disclosed in U.S. Pat. No. 518,931 where a toy is shown in which the inclination of the guidelines can be reversed while U.S. Pat. No. 2,388,513 shows the use of a line connected to a toy airplane on a line to effect the release of toy bombs. U.S. Pat. No. 3,838,855 disclosed a toy airplane carried by a support line connected to a fixed reel, and U.S. Pat. No. 4,522,605 shows a toy operable over an inclined guideline extending between two fixed supports and runs over fixed support eye to a freely held reel with handle extensions.

The term "prior art" as used herein or in any statement made by or on behalf of applicant means only that any document of thing referred to as prior art bears, directly or inferentially, a date which is earlier than the effective date of this application.

SUMMARY OF THE INVENTION

In accordance with the present invention an exciting, high speed, and smooth working flying toy is provided capable of being wind driven in both directions on one or more lines. The toy of the present invention may be controlled by the user or users in a variety of ways not previously available. The direction of flight of the toy may be reversed simply by rotation of the handles 180 degrees or other methods to alter the pitch of the sail. Pitch adjustment may be accomplished by varying the distance between guidelines or other methods as will be discussed hereafter.

To accomplish these and other objects and advantages, a flying toy, in one embodiment, comprises a first and a second guideline. Each guideline has two ends and each end includes a handle secured thereto. The handle may, at each end of the guideline, connect both guidelines, or a separate handle may be provided for each end of each guideline. A body member for operating aerodynamically includes a frame and a sail element. Fasteners are secured to the frame and to the guidelines, or may be integral with the frame. In one embodiment, support elements are secured to the body member and to the fasteners for supporting the body member in a desired orientation between the first and the second guidelines. Alternatively, the frame may be configured to provide the support of the body member in a desired orientation between the first and the second guidelines.

Alternative embodiments employing one-piece or frameless structures, single line embodiments, as well as alternative handle designs will be discussed in detail hereafter.

It is therefore a principal object of the present invention to provide a flying toy which is wind driven in both directions, runs on one or more guidelines, and reverses directions by rotating the handles 180 degrees transversely.

A further object of the present invention is to provide a flying toy in which control of the sail pitch adjustment is allowed by varying the width of the guidelines in relation to one another thereby controlling the pitch of sail, or by repositioning the sail element within an independent rigid frame.

A still further object of the invention is to provide a flying toy which may be flown using either a horizontal, vertical, or other angular orientation of the guidelines and may be used by one or two participants.

An additional object of the invention is to provide a device which may be of a one-piece or composite frameless design.

An additional object of the invention is to provide a device which may be operated on a single guideline.

An additional object of the invention is to provide a device which is easily manufactured and assembled.

An additional object of the invention is to provide a safe handle structure which will prevent injury to the user of the device during moderate or high speed operation.

Further objects and advantages of the invention will become apparent from a consideration of the ensuing description and the accompanying drawings.

DESCRIPTION OF THE PREFERRED EMBODIMENTS

Figure 1:
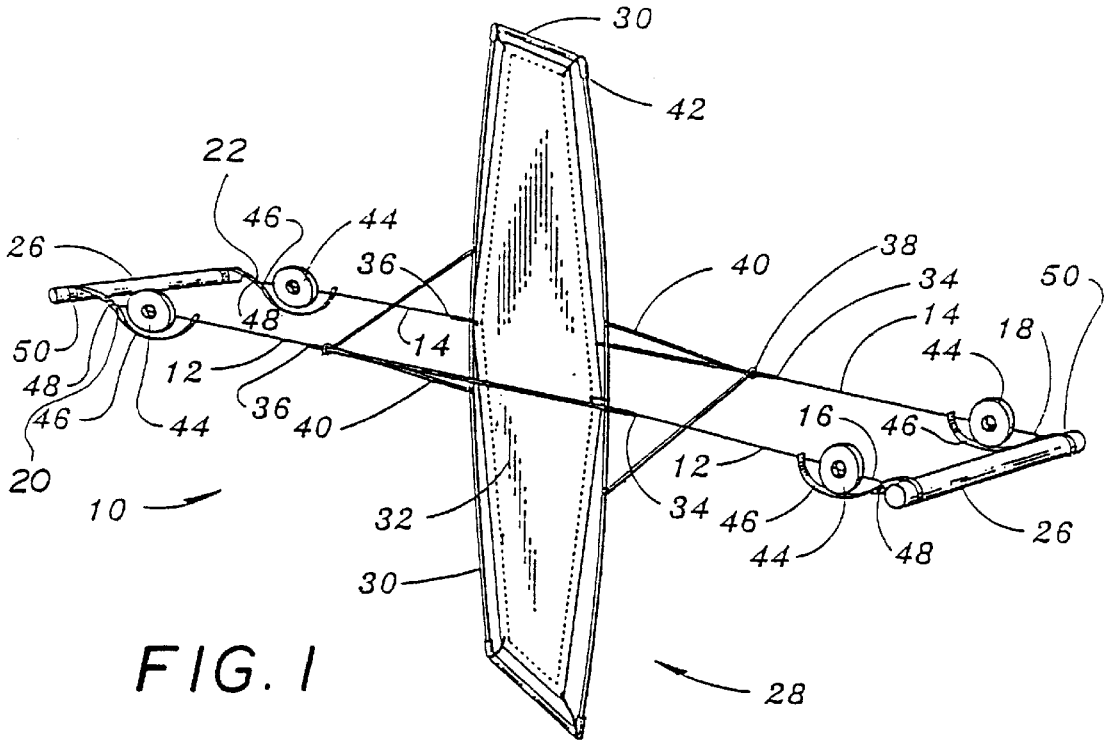
FIG. 1 shows a front perspective view of a flying toy according to the invention.
Figure 2:
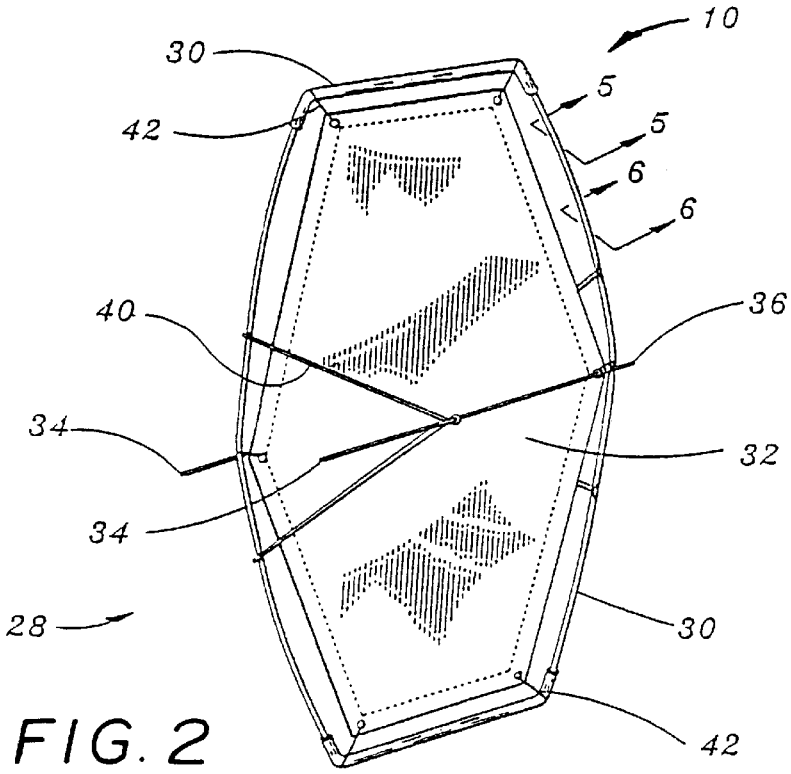
FIG. 2 shows a perspective view of such flying toy illustrating the operation of support element 40 and fasteners 34.

FIGS. 1 and 2 show a flying toy 10 according to a preferred embodiment of the invention. The toy 10 comprises a first guideline 12 having a first end 16 and a second end 20, and a second guideline 14 having a first end 18 and a second end 22. The first and second guidelines are preferably made out of monofilament fishing line, however, a cord, wire, string, or the like, may be substituted for the fishing line material.

The pair of guidelines 12 and 14 may be of various lengths and materials. In addition, a reel mechanism (not shown) may be incorporated for selection of line lengths used during play and for winding during non-use(i.e. storage).

A handle 26 is secured to both ends of the first and second guideline and may be either one-piece, where one hand of a user controls one end of both guidelines with a single handle, or alternatively, a handle for each hand of the user may be provided so that each hand of a user controls one end of a guideline, or handles may be eliminated altogether and the users simply grasp or wrap ends 16, 18, 20, and 22 in their hands. A compressible bumper member 44 composed of compressible material, such as rubber, urethane, or plastic, is preferably secured to the guidelines near ends 16, 18, 20, and 22 to prevent discomfort or injury to the user when flying toy 10 approaches handle 26. Bumper member 44 may be spherically configured as shown in FIG. 1 and secured to the guidelines by knot 48 or mechanical fasteners such as snaps, clamps, pins, or the like. Straps 46 are preferably secured to handles 26 by snaps 50, clamps, pins, or other mechanical fasteners, or may be tied by a knot to handle 26. Alternatively, different shape bumper members may be used, such as tube configured bumper members 44 shown in FIG. 3, or any other shape adaptable to the guidelines. In the embodiment shown in FIG. 1, the guidelines are preferably secured to strap 46 which is fastened to handle 26; while in the embodiment shown in FIG. 3, the guidelines are secured directly to handle 26.

Figure 5:
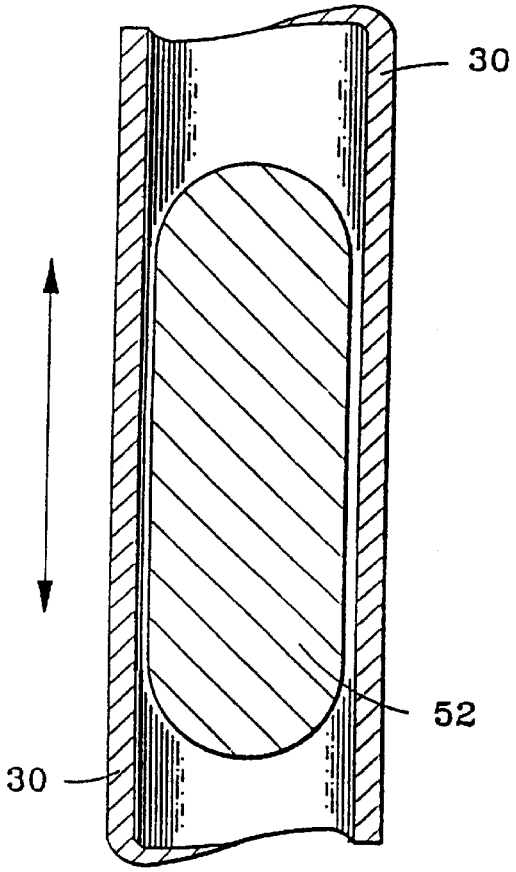
FIG. 5 shows a sectional view through line 5—5 of FIG. 2 of a stabilizing pin 52 in vertical frame member 30, according to the invention.
Figure 6:
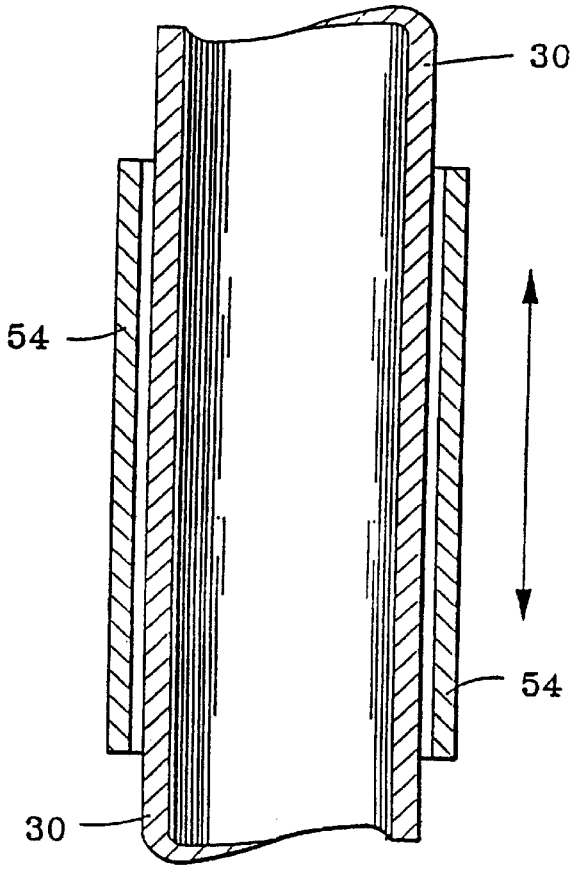
FIG. 6 shows a sectional view through line 6—6 of FIG. 2 of a sliding sleeve 54 on vertical frame member 30 as an alternative embodiment to stabilizing pin 52, shown in FIG. 5.

A body member 28, preferably comprises a frame 30 and a sail element 32 secured to the frame. The frame is preferably composed of rigid carbon graphite tubes, however, any lightweight rigid, durable material such as fiberglass rods, wood dowels, aluminum or metal alloy tubes, plastic tubes, rods, or the like, or alternatively one piece molded designs may be used. Sail 32 is preferably composed of a ripstop nylon cloth, however, any durable resilient material may be substituted for such material, such as TYVEK, mylar, foil, paper, plastic, cloth, rubber, foam sheeting or the like, and may include battens therein. A stabilizing pin 52 may be placed in each vertical member of frame 30, as shown in FIG. 5. Pin 52 may be substituted by granular metal, sand, liquid, and the like, inside the vertical frame member to achieve the same results. Pin 52, or the alternative elements if used, slides to the bottom of the vertical frame member whenever the sail is rotated 180 degrees, thus keeping the center of gravity at the bottom of frame 30 and thereby eliminating any tendency from frame 30 to tip from being slightly top heavy. FIG. 6 shows an alternative stabilizing implementation to that shown in FIG. 5 which may be incorporated into flying toy 10. In FIG. 6, four sliding sleeves, 54, one is shown in a sectional view in FIG. 6, and preferably one sleeve for each end of frame 30 vertical members, may be composed of metal, composite, plastic, or other durable, resilient materials, and are slideably secured to frame 30. Sliding sleeve 54 performs the same function as pin 52 shown in FIG. 5, namely keeping the center of gravity at the bottom of flying toy 10 even after rotation of sail 32, and is shown as an alternative to pin 52. Of course, other alternatives to pin 52 or sliding sleeve 54 are contemplated and use of such stabilization weights are optional on flying toy 10. The sail may be secured to frame 30 by cord 42, or by O-rings, shock cords, wire, string, rubber bands, adhesive, or any other conventional fastening device, or fastened directly thereto.

Figure 3:
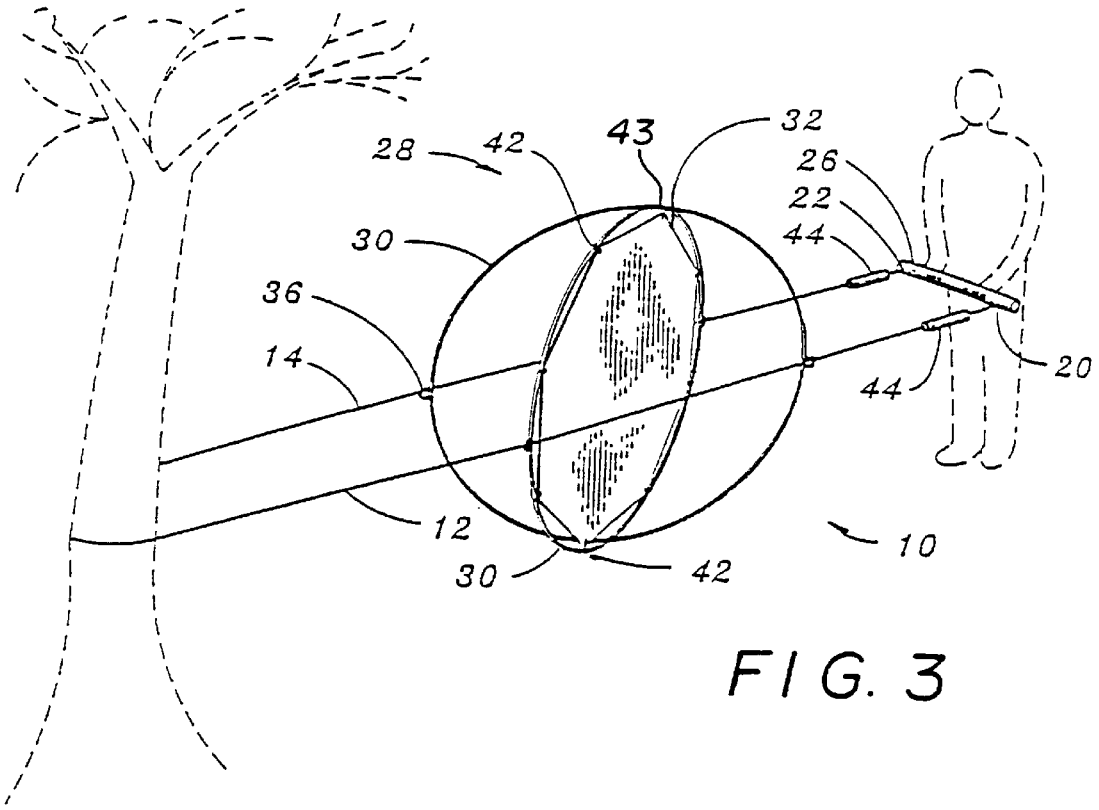
FIG. 3 shows a front perspective view of a flying toy with a spherical frame and octagonal sail, according to another embodiment of the invention.
Figure 4:
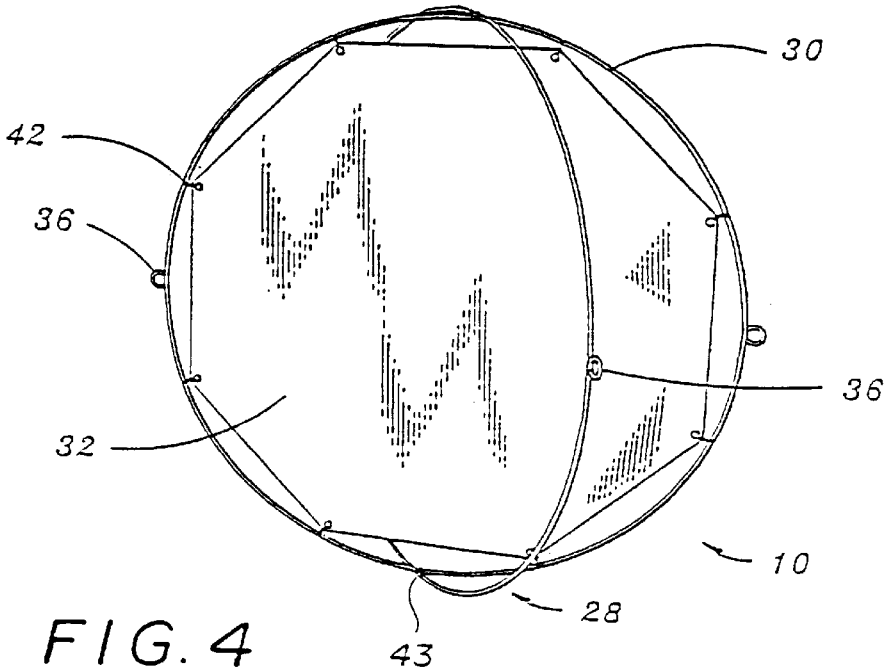
FIG. 4 shows an end view of the embodiment illustrated in FIG. 3 but not connected to guidelines.

The toy shown in FIGS. 1 and 2 has an elongated frame and sail configuration, while the embodiment shown in FIGS. 3 and 4 has an octagonal configuration. Any shape or configuration of frame and sail may be used for body member 28, for example, triangular, pentagon, circular, etc. Body member 28 is preferably pivotally attached to guidelines 12 and 14 by fastening elements 34, shown in FIGS. 1 and 2 as elongated tubular members 34 through which guidelines 12 and 14 pass through, however, body member 28 may be secured to guidelines 12 and 14 by a plurality of eyelets 36, a plurality of split ring fasteners 38, roller bearings, or any other mechanical fastener capable of slideably securing body 28 to guidelines 12 and 14.

Support elements 40 are shown in FIGS. 1 and 2 and are slideably connected to tubular fastener 34. Support elements 40 may be slid down frame 30 or detached when toy 10 is to be packed, stored, or transported and toy 10 folds up into a flat easily carried or stored configuration. To re-open, support elements 40 are slid up or reattached to frame 30 and toy 10 is ready again for use. Support element 40 may be built as a part of frame 30 or as an independent element. In use, support elements 40 may be adjusted to control the angle of sail 32 within guidelines 12 and 14 by sliding the supports either up or down frame 30. Alternatively, other embodiments such as those shown in FIGS. 3 and 4, will not include support elements 40, instead; frame 30 will be constructed, for example, out of tubular fiberglass flexible rods and support body 28 thereby in a desired orientation between guidelines 12 and 14, with frame connection 43 allowing sail pitch adjustability.

Referring now specifically to FIGS. 3 and 4, an alternative embodiment of flying toy 10 is illustrated. The embodiment shown in FIGS. 3 and 4 has a sail 32 with an octagon configuration. In this embodiment, it is preferable to use eyelets 36 to secure frame 30 to guidelines 12 and 14, however, as with the embodiment shown in FIGS. 1 and 2, alternative fasteners such as split ring fasteners, roller bearings, or the like may be utilized. The configuration of sail 32, although shown as an octagon in FIGS. 3 and 4, may be any shape, for example, spherical, triangular, pentagonal, or novelty shapes such as animals, fish, cartoon characters, artistic designs, and the like.

For embodiments of flying toy 10 such as illustrated in FIGS. 3 and 4 which utilize a spherical frame configuration, frame 30 is preferably constructed out of a flexible, durable material such as fiberglass flexible rods, tubular metal, or plastic. For ease of assembly and disassembly, shock cord linkers/connectors may be used within the frame members, as well as with the embodiment illustrated in FIGS. 1 and 2. As with the embodiment shown in FIGS. 1 and 2, the embodiment shown in FIGS. 3 and 4 is capable of use with a horizontal or vertical line orientation, frame and sail direction may be reversed on the guidelines by simply rotating handles 26 by 180 degrees. It may be used by one or two participants, and sail pitch adjustments can be made by varying the relative width of guidelines 12 and 14 to one another, as well as manipulating the frame connection 43.

In operation and use, flying toy 10 may be used by either one or two users. Flying toy 10 is very simple to assemble, use, disassemble, and store. The user, to assemble the embodiments shown in FIGS. 1 and 2, simply slides support elements 40 to an open position, extends guidelines 12 and 14, and then each participant takes hold of a handle. To control frame 30 and sail 32 on guidelines 12 and 14, the user simply rotates handle 26 180 degrees transversely to the guidelines thereby reversing sail angle and flying toy 10 reverses direction. In this way, when flying toy 10 reaches one end of the guidelines the user at that end rotates handles 26 and the toy glides down guidelines 12 and 14 to the other user's end. If each end of guidelines 12 and 14 are supplied with two handles instead of one, the users may also control the sail pitch by varying the width or height of guidelines 12 and 14 in relation to one another.

If support elements 40 are used, such as illustrated in FIGS. 1 and 2, the angle and orientation of sail 32 may be adjusted by sliding the supports up or down frame member 30. Flying toy 10 maybe used for play, competition, racing, educational activities, stunts, and the like. Because of the unique control of the sail and frame possible with the present apparatus, numerous activities are possible beyond simply flying the toy, such as picking up objects, sending messages between users, configuring sail 32 as a plane and sending cargo or dropping play bombs, or the like.

Figure 8:
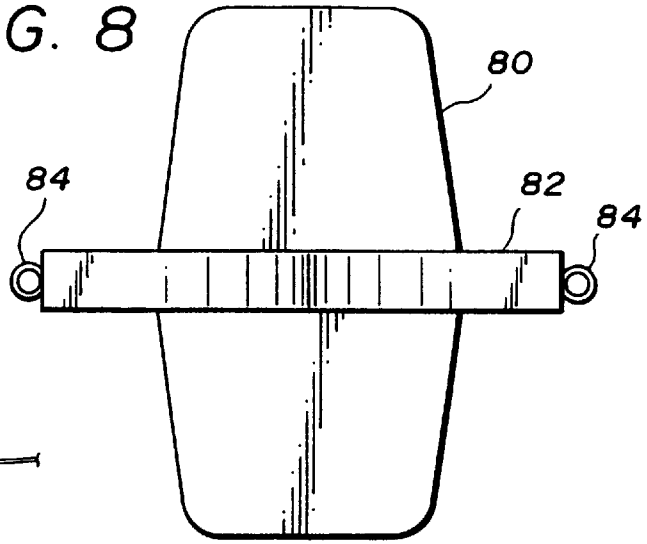
FIG. 8 shows a front view of the hollow center frameless two-piece flying toy of FIG. 9.
Figure 9:
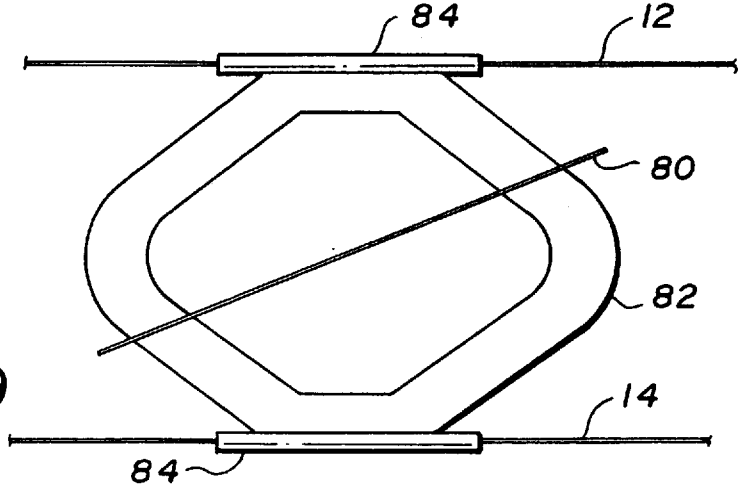
FIG. 9 shows a top view of a hollow center frameless two-piece flying toy.
Figure 7:
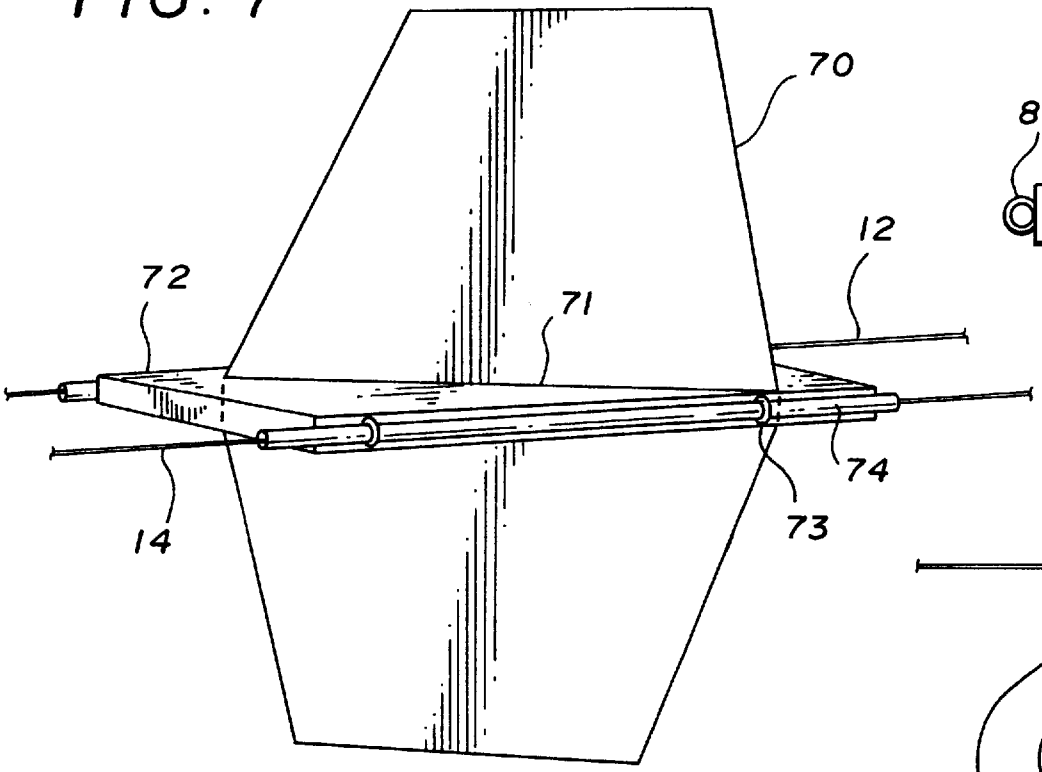
FIG. 7 shows a side view of a frameless two-piece flying toy.

Frame 30 may be eliminated if more than two guidelines are used or a sufficiently rigid sail material utilized. In an alternative embodiment, the frame may be eliminated by utilization of a composite wind driven structure comprising a rigid sail and support structure slideably connected to one or more guidelines. Alternately, the structure may be unitary with a one-piece molded, formed, or otherwise fabricated structure replacing the composite sail and support structures. FIGS. 7, 8 and 9 collectively, and 12 illustrate frameless embodiments of the present invention.

FIG. 7, illustrates a solid one-piece sail 70 which has been inserted within support structure 72 through slot 71. The sail is placed at an angle across the structure 72. The specific angle can be chosen to alter the dynamics of flight. Guidetubes 74 are secured along the longitudinal axis of the support structure by securing means 73. Guidelines 12 and 14 are fed through the guide tubes and operate in a like manner to guidelines 12 and 14 of the above disclosed embodiments. The solid one-piece sail and support structures may be made of simple folded cardboard, fiberboard, styrofoam, high density foams, molded plastics, vacuum formed plastics, foam board, balsa wood, corrugated plastics, molded foams or other equivalent materials. Furthermore, any resilient materials, such as mylar or vinyl, that can be inflated under pressure to form a rigid sail or support structure may be used. In addition, the solid one-piece sail and support structure may be integrally fabricated, formed or molded into a unitary flying toy structure (not shown).

The guidetubes, eyelets or other fasteners for slideably connecting the flying toy to the guidelines may be secured to the support structure and/or sail structure by any of numerous common securing means, including but not limited to, brackets, glue, snaps, fitted openings and the like. Alternatively, the slideable connection may be integrally formed, molded, or fabricated into the support structure and/or sail structure; or the slideable connection may be integrally formed, molded, or fabricated into the unitary structure.

Using a single sheet cardboard material would enable construction of the present invention from the back of a cereal box, for example. The device would be cutout and assembled using, for example, drinking straws for the guide tubes 74.

FIGS. 8 and 9 illustrate a one-piece, rigid sail, frameless embodiment wherein the support structure 82 has a hollow center section to reduce weight. This embodiment has a solid sail 80, cut-out support structure 82, guidetubes 84 (integral with support 82 or secured thereto) and is operated with guidelines 12 and 14. The structure 82 could be a two-piece support structure that snaps together around the sail 80, a one-piece support structure with slots to receive the sail therethrough or integrally formed or molded with sail 80(not shown).

FIGS. 10*a*, 10*b*, 10*c* and 10*d* each show various embodiments directed to alternative handle structures.

Figure 10A:
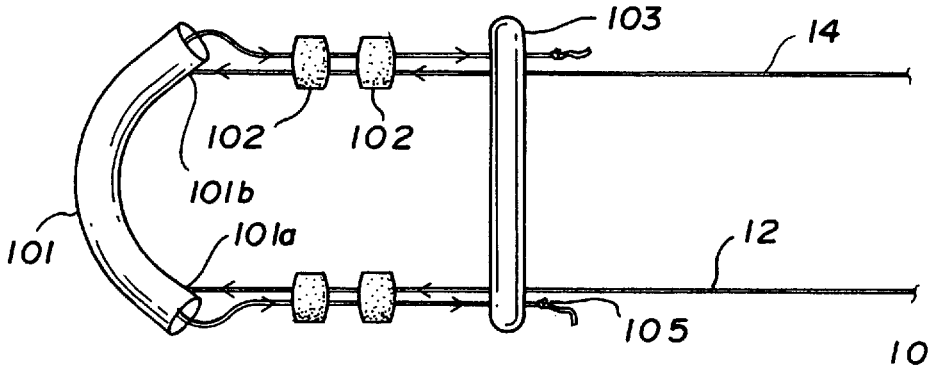
FIGS. 10*a*, 10*b*, 10*c* and 10*d* each detail alternative handle structures.

FIG. 10*a* illustrates a rigid or semi-flexible handle 101 with eyelets 101*a* and 101*b*. Guideline 14 is fed through rigid deflection section 103, absorption spacers 102, eyelet 101*b*, back through the spacers and deflection section and secured by knots 105 or other equivalent methods of retaining the guidelines therein. Guideline 12 is secured in a similar manner. Numerous other methods are possible for securing absorption spacers between handle 101 and deflection section 103 (e.g. glue, slideable connection of deflection section to handle, strap, etc.). A variable number of spacers or absorption spacers of variable thicknesses can be used depending upon the speed and/or weight of the wind driven structure to achieve adequate protection of both the flying toy and user's hand(s).

The handle and deflection section can be constructed of PVC, ABS plastic, polystyrene, nylon, wood, metal alloy, rubber or equivalent materials, with a comfort grip made of foam, leather, cork, fabric tape, vinyl rubber or equivalent materials (not shown). The absorption spacers can be constructed of high density compressible foam. In operation, the wind driven structure could come in contact with section 103 which would then be elastically absorbent of the forces imparted thereon.

Figure 10B:
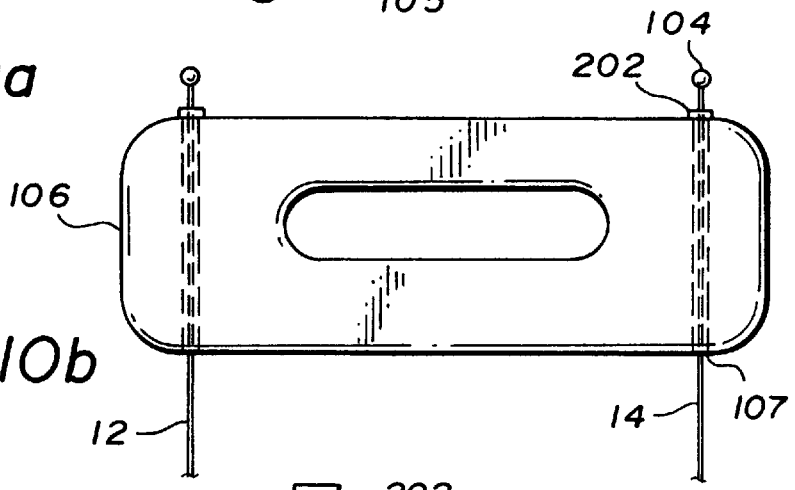

FIG. 10*b* illustrates a semi-rigid handle structure 106 with guideline channels 107. The handle could be made of various shapes and materials such as a molded, die-cut or fabricated high density foam handle. Whereas handle 10*a* had a plurality of parts to provide for finger protection and shock absorption, handle 10*b* provides for all of these desirable features by integrating these functions into substantially single monolithic structure. The high density foam has sufficient rigidity to serve as a durable handle means, and at the same time is sufficiently compressible to absorb energy on impact to prevent damage to the flying toy and to increase longevity by reducing cyclic shock fatigue. The high density foam completely encloses the finger area thereby providing for positive finger protection. Lines may be directly attached to the handles by a variety of attachment means including threading lines through guideline channels 107 provided in the handle and optional bushing 202. The line is then knotted or attached to a stopper object 104 such that the line cannot pass back through the channel.

Figure 10C:
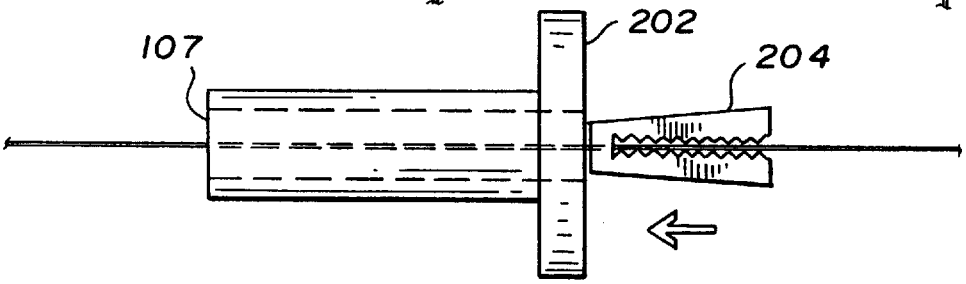

An alternate means for securing the line is shown in FIG. 10*c*. With this method of line attachment, the lines pass through channel 107, bushing 202 and taper clamping pin 204. When the line is the correct length and in proper adjustment, the taper pin is inserted into bushing 202 which causes the taper pin to clamp onto the line, thereby securing the line to the handle. This method provides for easy adjustment of the line length by simply removing the taper clamping pin from the bushing which allows the line to move to a new position before clamping again. Bushing 202 may be eliminated if the stopper means is sufficiently large to prevent the line from pulling back through the somewhat stretchable hole in the foam handle. The bushing may be made from plastic, wood, metal alloy or other rigid light weight material. This alternative securing method can be incorporated into any of the disclosed handles or equivalents thereof.

Another variation of the above design is the inflatable handle (not shown), or permanently inflated handle, that is inflated to the appropriate pressure to provide sufficient rigidity for a handle function while at the same time maintaining a degree of compressibility to provide the energy absorbing function.

Figure 10D:
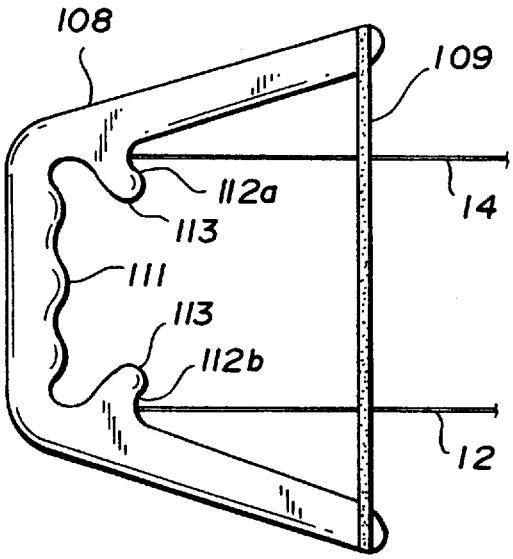

FIG. 10*d* illustrates a handle 108 supporting an elastic structure 109. The guidelines 12 and 14 are secured to eyelets 112*a* and 112*b*. The handle has a finger receiving section 111 to increase gripping and comfort and protection sections 113 which both protect the fingers from contact with the flying toy structure and prevent forward movement of the hand from the gripping section 111. The elastic structure could be made of a heavy rubber band or other equivalent elastic structures and the handle could be injection molded, die-cut or fabricated plastic, wood, metal alloy or equivalents thereof. In operation, the flying toy structure would be elastically reflected by elastic member 109, thereby preventing contact with the user's hand, damage to the flying toy and enhanced play action.

Figure 11:
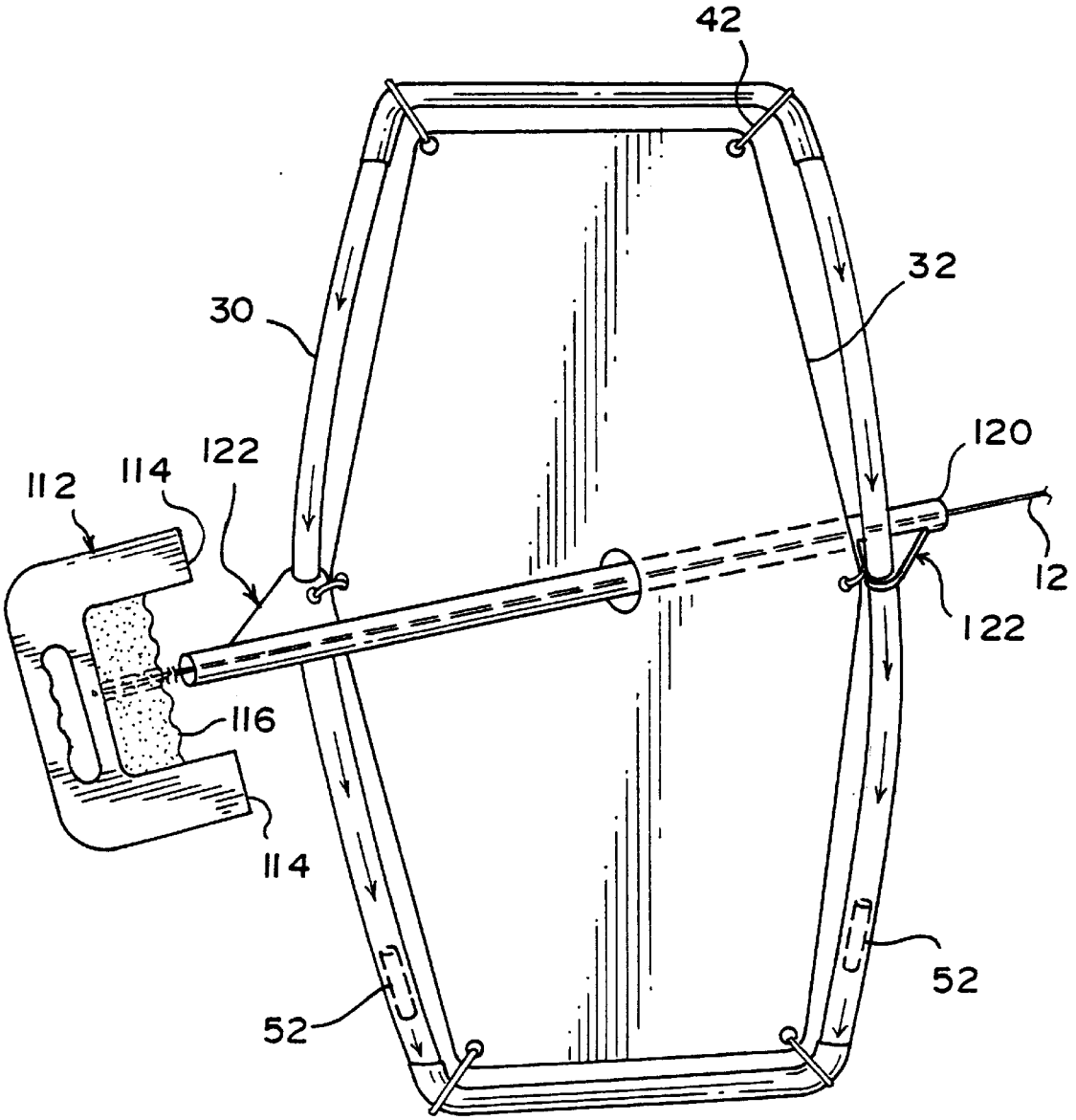
FIG. 11 illustrates a single guideline embodiment of the present invention.

FIG. 11 illustrates a single line embodiment of the present invention. A single line would provide a reduction in materials, eliminate twisting of lines and unwanted twisting and flipping. The frame and sail structure are similar to that shown in FIG. 2. The guidetubes 34 have been replaced by a single guidetube 120 extending across the width of the sail and through an opening in the sail. Two extensions 122 comprise the support structure and are integrated with the guidetube to place the sail at an angle (i.e. pitch) with respect to the guidetube. The extensions 122 can be integrally molded with the guidetube or be attached by various methods and can be of various shapes and sizes according to desired flight characteristics. Only the single guideline 12 is necessary for directing the flight path of the wind driven structure.

In operation, the wind driven structure would traverse the length of the guideline until coming in contact with the handle of a user. Upon contact, a user would manually change the pitch of the sail by flipping the wind driven structure 180 degrees either by hand or by interaction with the handle.

FIG. 11 additionally illustrates a handle 112 wherein sections 114 engage the frame 30. Foam 116 absorbs the flying toy impact. Rotation of the handles 180 degrees would result in an equivalent rotation of the frame and sail structure allowing travel in an opposite direction. In this embodiment, the sliding stabilization pin 52, or equivalent, is used as previously discussed (FIG. 5) to stabilize the flying toy's sail structure in a substantially vertical orientation. These sliding weights of liquid or solid material are moved by gravity, when the wind driven structure is rotated 180 degrees, to the new bottom of the wind driven structure thereby reversing the center of gravity to the bottom portion of the wind driven structure. The sliding stabilization weights may be internally or externally mounted on the wind driven structure.

Figure 12:
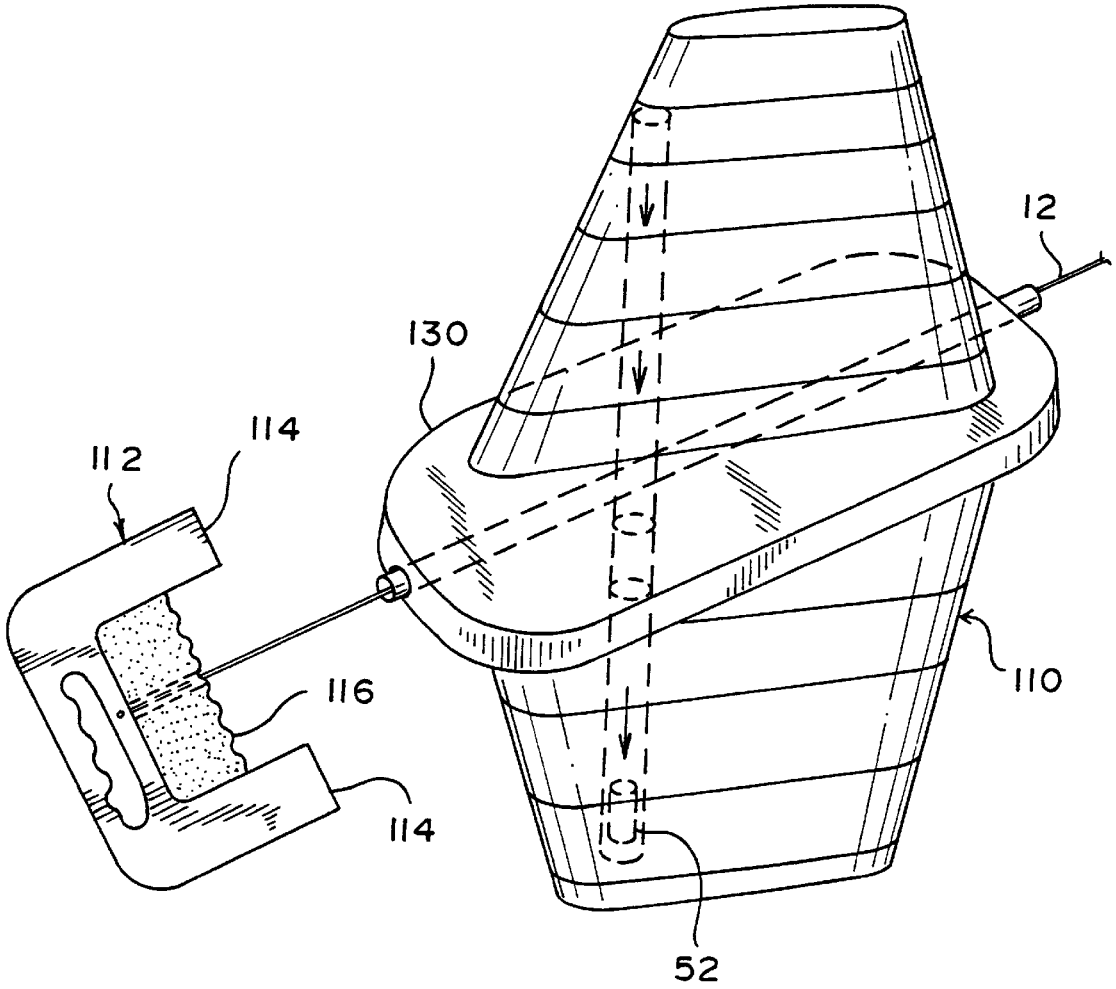
FIG. 12 illustrates a frameless single guideline embodiment of the present invention.

FIG. 12 illustrates a frameless single line embodiment of the present invention. The frameless embodiment works essentially as the above frame embodiment. The support structure 130 engages and is flipped by handle sections 114. In this embodiment, only a single stabilizing weight is used for stabilization.

Flight reversal, in the preferred embodiment, is performed by 180 degree rotation of the handles during play. In alternative embodiments, the sail structure can be pivotally mounted(not shown) within the support structure allowing the pitch of the sail to change by operator adjustment; the pitch is changed automatically by utilizing the kinetic energy upon impact at the end of travel to shift the position of the sail; the guidelines are attached to a composite handle (not shown) which mechanically provides rotation independent of the handle grip portion, or the lines can be given a partial twist which when encountered by the wind driven structure causes the structure to flip approximately 180 degrees, thereby reversing the pitch of the sail and changing the direction of flight without the operator having to rotate the handle.

CONCLUSION

While the above description contains many specificities, they should not be construed as limitations on the scope of the invention, but merely as exemplifications of preferred embodiments thereof. Those skilled in the art will envision many other possible variations are within scope. For example, the dimensions and shapes of the various embodiments may be altered, or alternative materials used to construct the frame, sail, connectors, sail support structure and unitary structure. The guidelines may be provided in a vertical, horizontal orientation, or incremental orientations other than true horizontal or true vertical, and various materials may used for the guidelines and or guidetubes. These and other variations may be made and still be within the scope of the invention. Accordingly, the scope of the invention should be determined by the appended claims and their legal equivalents, and not limited by the examples which have been given.

We claim:

1. A wind driven flying toy comprising:

(a) a first guideline having a first end and a second end, a second guideline having a first end and a second end;

(b) a first handle joining said first end of said first guideline and said first end of said second guideline and a second handle joining said second end of said first guideline and said second end of said second guideline; and (b) a wind driven structure slidably secured to said first guideline and to said second guideline in such a manner that said first guideline is oriented substantially parallel to said second guideline, said wind driven structure being motivated in a first motivating direction by wind power from a first wind direction acting upon said wind driven structure;

wherein said first motivating direction of said wind driven structure by said wind power from a first wind direction is modified to a second motivating direction by altering the orientation of said first guideline with respect to said second guideline.

2. A wind driven flying toy in accordance with claim 1, wherein said wind driven structure comprises a sail element, said sail element oriented at a first pitch with respect to one of said guidelines.

3. A wind driven flying toy in accordance with claim 1, wherein said first motivating direction of said wind driven structure by said wind power from a first wind direction is altered to a second motivating direction by rotating said first handle and said second handle.

4. A wind driven flying toy in accordance with claim 2, wherein altering said first pitch of said sail element to a second pitch alters the motivation of said wind driven structure from said first motivating direction to a second motivating direction.

5. A wind driven flying toy in accordance with claim 2, wherein altering said first pitch of said sail element to a second pitch reverses the motivation of said wind driven structure from said first motivating direction to a second motivating direction.

6. A wind driven flying toy in accordance with claim 5, wherein said first pitch of said sail element is altered to said second pitch by a physical interaction of said wind driven structure with one of said first handle or said second handle.

7. A wind driven flying toy in accordance with claim 1, wherein said wind driven structure is a composite structure comprising a sail element and a support element.

8. A wind driven flying toy in accordance with claim 7, wherein said support element is a multi-piece support structure attached to said sail element in such a manner as to secure said sail element to said support element.

9. A wind driven flying toy in accordance with claim 7, wherein said support element is a multipiece support structure attached through said sail element in such a manner as to secure said sail element to said support element.

10. A wind driven flying toy in accordance with claim 7, wherein at least one of said support element and said sail element is a resilient air filled structure.

11. A wind driven flying toy in accordance with claim 7, wherein said wind driven structure is in the form of a unitary wind structure.

12. A wind driven flying toy in accordance with claim 2, wherein said sail element is provided with one or more openings and further comprising a plurality of elongated tubular elements, each of said plurality of elongated tubular elements encapsulating one of said first and second guideline, wherein said sail element is secured to said first guideline and to second guideline by said plurality of elongated tubular elements which pass through said one or more openings in such a manner that said sail element is maintained at a fixed angle with respect to one of said plurality of elongated tubular elements.

13. A wind driven flying toy in accordance with claim 2, wherein said sail element is manufactured from a foam, plastic or wood material.

14. A wind driven flying toy in accordance with claim 3, wherein said first and second handles are rotated 180 degrees.

15. A wind driven flying toy in accordance with claim 1, wherein said wind driven structure is secured to said first guideline and to said second guideline by a plurality of elongated tubular elements.

16. A wind driven flying toy in accordance with claim 5, wherein said first pitch of said sail element is altered by a physical interaction of said wind driven structure with an operator of said flying toy.

17. A wind driven flying toy in accordance with claim 7, wherein said composite wind driven structure is manufactured from one or more sheet materials.

18. A wind driven flying toy in accordance with claim 7, wherein said sail element is secured to said support element by insertion of said sail element through an opening in said support element.

19. A wind driven flying toy in accordance with claim 1, wherein at least one of said first and second handles is a composite handle comprising wind driven structure deflector means, energy absorbing means and means for holding said composite handle comfortably in an operator's hand.

20. A wind driven flying toy in accordance with claim 1, wherein at least one of said first and second handles substantially comprise a high density foam material that provides for a comfortable grip, energy absorption upon impact of said wind driven structure and protection for an operator's fingers.

21. A wind driven flying toy in accordance with claim 1, wherein at least one of said first and second handles is a composite handle comprising a rigid handle means, a pair of extension arms and an elastic structure spanning the pair of extension arms.

22. A wind driven flying toy in accordance with claim 1, wherein said first and second guidelines are secured to said first and second handle by connection means selected from the group consisting essentially of knots, clamps, loops, winding, compression, taper pins, posts, eyelets, holes, hooks, snaps, and glue.

23. A wind driven flying toy in accordance with claim 1, wherein at least one of said first and second handles include a line length adjustment device.

24. A wind driven flying toy in accordance with claim 1, wherein said wind driven structure comprises a sail and a frame.

25. A wind driven flying toy in accordance with claim 1, wherein said wind driven structure comprises a support structure having a sail attached thereto.

26. A wind driven flying toy in accordance with claim 11, wherein said wind driven structure comprises a single-piece of sheet material.

* * * * *